US008043050B2

(12) United States Patent
Heinz-Schwarzmaier et al.

(10) Patent No.: US 8,043,050 B2
(45) Date of Patent: Oct. 25, 2011

(54) GAP SEAL IN BLADES OF A TURBOMACHINE

(75) Inventors: Thomas Heinz-Schwarzmaier, Birmenstorf (CH); Sven Olmes, Villigen (CH); Ronald Wifling, Waldshut-Tiengen (DE)

(73) Assignee: ALSTOM Technology Ltd., Baden (CH)

( * ) Notice: Subject to any disclaimer, the term of this patent is extended or adjusted under 35 U.S.C. 154(b) by 880 days.

(21) Appl. No.: 12/057,506

(22) Filed: Mar. 28, 2008

(65) Prior Publication Data

US 2008/0247867 A1 Oct. 9, 2008

(30) Foreign Application Priority Data

Apr. 5, 2007 (CH) ..... 0573/07

(51) Int. Cl.
*F01D 1/00* (2006.01)

(52) U.S. Cl. ..... 415/139; 415/191; 415/228; 415/110

(58) Field of Classification Search ..... 415/110, 415/134, 135, 139, 175, 191, 228
See application file for complete search history.

(56) References Cited

U.S. PATENT DOCUMENTS

| | | | | |
|---|---|---|---|---|
| 3,970,318 | A * | 7/1976 | Tuley | 415/139 |
| 3,981,609 | A * | 9/1976 | Koenig | 415/117 |
| 3,995,971 | A * | 12/1976 | White | 415/160 |
| 4,623,298 | A * | 11/1986 | Hallinger et al. | 415/139 |
| 5,290,144 | A * | 3/1994 | Kreitmeier | 415/173.1 |
| 6,261,053 | B1 * | 7/2001 | Anderson et al. | 415/115 |
| 6,270,311 | B1 * | 8/2001 | Kuwabara et al. | 415/110 |
| 6,893,215 | B2 * | 5/2005 | Kuwabara et al. | 415/139 |

(Continued)

FOREIGN PATENT DOCUMENTS

| | | |
|---|---|---|
| EP | 1221539 | 7/2002 |
| EP | 1408199 | 4/2004 |
| WO | WO00/57031 | 9/2000 |

OTHER PUBLICATIONS

Search Report for Swiss Patent App. No. 00573/07 (Sep. 28, 2007).

(Continued)

*Primary Examiner* — Igor Kershteyn
(74) *Attorney, Agent, or Firm* — Cermak Nakajima LLP; Adam J. Cermak

(57) ABSTRACT

A gap seal (9) radially seals a gap (8) which extends axially and radially between two blades (1, 2) of a turbomachine which are adjacent in the circumferential direction (3). The two blades (1, 2) have, in each case, an axially extending longitudinal slot (10, 11), which is open towards the gap (8), on its respective blade root (6, 7). A band-form or strip-form sealing element (12) engages with its longitudinal sides (13, 14) in the two longitudinal slots (10, 11) and bridges the gap (8). The one blade (1) has a projection (15) on its blade root (6), which projects from the blade root (6) in the circumferential direction (3) and extends in the circumferential direction (3) and radially, at least in the region of the respective longitudinal slot (10), and bridges an axial longitudinal end of the gap (8) in the process. The other blade (2) has a step-shaped recess (16) on its blade root (7), complementary to the projection (15) of the one blade (1) and in which the projection engages. The projection (15) has a transverse slot (17) which extends in the circumferential direction (3) and is open towards the gap (8). The sealing element (12) engages with an end face (18) in the transverse slot (17).

6 Claims, 1 Drawing Sheet

U.S. PATENT DOCUMENTS

| | | | | |
|---|---|---|---|---|
| 6,910,854 | B2 * | 6/2005 | Joslin | 415/139 |
| 2005/0135925 | A1 | 6/2005 | Shiozaki et al. | |
| 2005/0186074 | A1 | 8/2005 | Tomita et al. | |

OTHER PUBLICATIONS

Search Report from EP Patent App. No. 08153316.8 (Oct. 23, 2008).

* cited by examiner

GAP SEAL IN BLADES OF A TURBOMACHINE

This application claims priority under 35 U.S.C. §119 to Swiss application no. 00573/07, filed 5 Apr. 2007, the entirety of which is incorporated by reference herein.

BACKGROUND

1. Field of Endeavor

The present invention relates to a gap seal for radial sealing of a gap which extends axially and radially between two blades of a turbomachine which are adjacent in the circumferential direction.

2. Brief Description of the Related Art

In turbomachines, that is to say compressors, turbines and the like, blades are arranged adjacent to each other in the circumferential direction. In this case, gaps occur in the region of the blade roots, especially in the case of rotor blades which are arranged on the rotor side, which gaps extend in each case axially and radially between the blade roots of adjacent blades. In order to avoid the entry of hot gases into the gap, or in order to avoid the escape of cooling gas from the gap, it is necessary to seal this gap in the radial direction. For this purpose, in each two blades which are adjacent in the circumferential direction, it is basically possible to provide in each case an axially extending longitudinal slot, which is open towards the gap, on its respective blade root. A band-form or strip-form sealing element can then be inserted in these longitudinal slots, which lie in alignment opposite each other in the gap, in such a way that it engages with its longitudinal sides in the two longitudinal slots, and so bridges the gap.

With such gap seals, however, a residual gap can still exist on the end-face end of the sealing element. This can be attributed to manufacturing tolerances. Furthermore, this residual gap can be formed or enlarged due to thermal expansion effects during operation of the turbomachine.

SUMMARY

One of numerous aspects of the present invention deals with an improved embodiment for a gap seal of the aforementioned type, which can be especially characterized by an increased sealing effect.

Another aspect of the present invention is based on the general principle of allowing the sealing element to also engage in its end-face end in a corresponding slot so that no residual gap remains. For this purpose, a projection is formed on one of the two blades, between the roots of which the gap exists, and projects in the circumferential direction from the blade root of the one blade, and in the process extends in the circumferential direction and in the radial direction, at least in the region of the longitudinal slot of this blade. Complementary to this, the other blade has a matching recess on its blade root in which the projection engages. In this way, the projection can overlap the gap in the circumferential direction. A transverse slot, into which the end face of the sealing element can be inserted, can now be recessed into this projection. As a result of the described type of construction, the gap can now also be sealed in the region of the end-face end of the sealing element. The effectiveness of the gap seal which is formed in this way is therefore improved.

According to a preferred embodiment, the projection can be dimensioned so that on the one hand it overlaps the axially open ending longitudinal slot of the other blade, and so that on the other hand it is large enough in order to configure the transverse slot, which is recessed therein, to be closed on its end-face ends. As a result of this embodiment, the sealing effect of the gap seal can be additionally improved.

Furthermore, the projection and the recess can be optionally matched to each other so that the projection lies in the recess axially on the blade root of the other blade. With this type of construction, the transverse slot in the projection of the one blade merges almost seamlessly into the longitudinal slot of the other blade. Also as a result of this, the sealing effect of the gap seal can be improved.

Further important features and advantages of the gap seal according to the invention result from the drawings and from the associated figure description with reference to the drawings.

BRIEF DESCRIPTION OF THE DRAWINGS

Preferred exemplary embodiments of the invention are shown in the drawings and are explained in more detail in the subsequent description, wherein the same designations refer to the same or similar, or functionally the same components. In the drawing, schematically in each case.

DETAILED DESCRIPTION OF EXEMPLARY EMBODIMENTS

Figure 2:
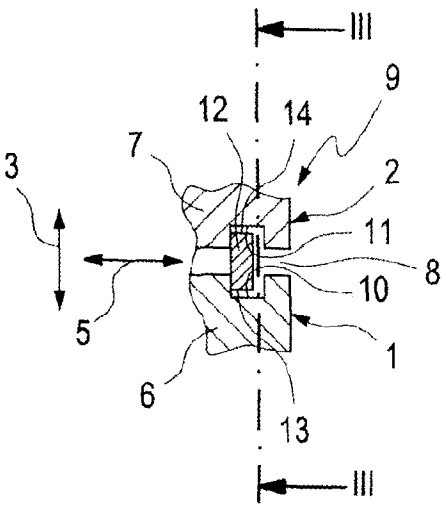
FIG. 2 shows a sectional view in the region of the gap seal corresponding to the intersection lines II in FIG. 1.
Figure 1:
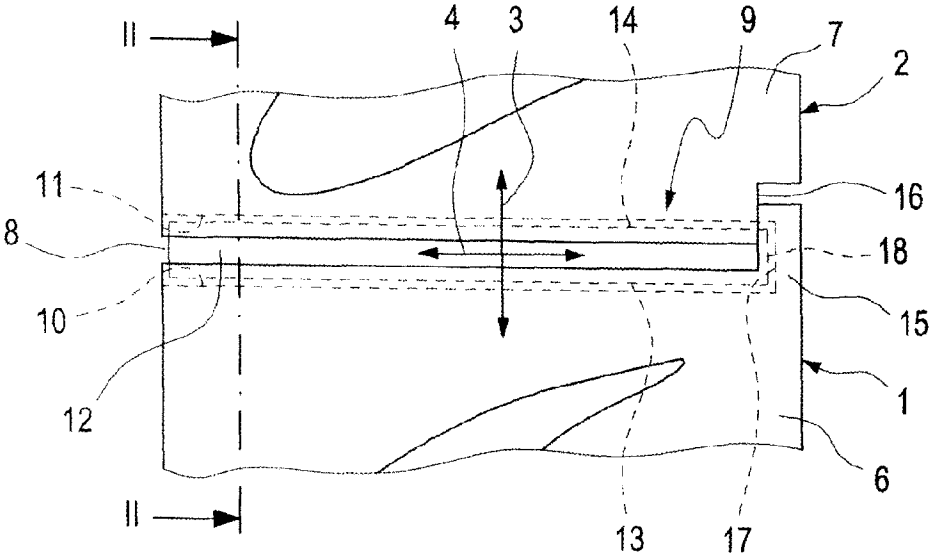
FIG. 1 shows a plan view in the radial direction of two blades, which are adjacent in the circumferential direction, in the region of a gap seal.
Figure 3:
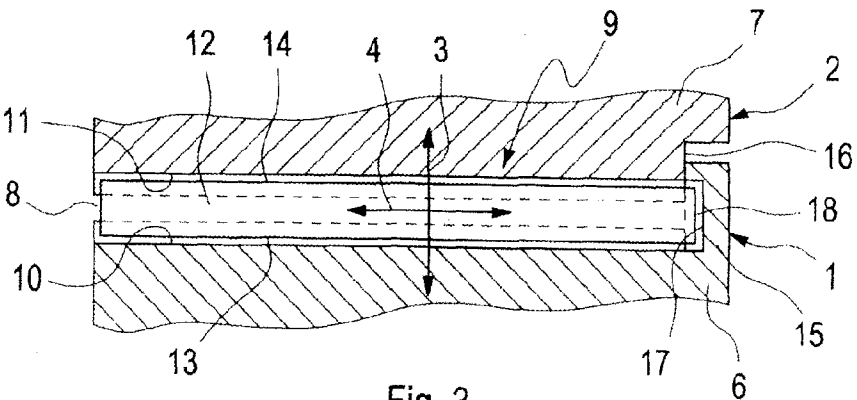
FIG. 3 shows a sectional view in the region of the gap seal corresponding to the intersection lines III in FIG. 2.

In FIG. 1, two blades, specifically a first blade 1 and a second blade 2, are partially shown, which form in each case a component part of a turbomachine which, apart from that, is not shown. This turbomachine for example is a turbine or a compressor. The turbomachine has a stator and a rotor which is rotatably arranged in the stator around a rotational axis. The previously and subsequently made direction references, such as axial direction, radial direction, and circumferential direction, in this case are in relation to the rotational axis in each case, which defines the axial direction. In FIGS. 1 to 3, the directions in relation to the rotational axis of the rotor are indicated by double arrows. In this case, the circumferential direction is designated 3, the axial direction is designated 4, and the radial direction is designated 5. The blades 1, 2 can be stator blades of the stator. Preferably, however, the blades 1, 2 are rotor blades of the rotor.

The two blades 1, 2 which are shown here are arranged adjacent to each other in the circumferential direction 3. Each blade 1, 2 has a blade root 6 or 7. The blade root 6 of the first blade 1 is subsequently also referred to as a first blade root 6. The blade root 7 of the second blade 2 is subsequently also referred to as a second blade root 7. Due to the type of construction of the turbomachine, a gap 8 is formed in the circumferential direction 3 between adjacent blades 1, 2 in the region of the blade roots 6, 7, and extends in the axial direction 4 and in the radial direction 5. For sealing this gap 8, a gap seal 9, which is subsequently explained in more detail, is formed in the region of the gap 8.

For realizing the gap seal 9, a longitudinal slot 10, which is subsequently also referred to as the first longitudinal slot 10, is recessed into the one blade 1, that is to say for example into the first blade 1, on its blade root 6. The first longitudinal slot 10 extends axially and is open towards the gap 8. Similarly to this, a longitudinal slot 11, which is subsequently referred to as the second longitudinal slot 11, is also recessed into the other blade 2, that is to say in this case into the second blade 2 or into its blade root 7. The second longitudinal slot 11 is also open towards the gap 8 and extends axially. The two longitudinal slots 10, 11 in this case are arranged on the respective blade root 6, 7 so that they lie opposite each other in the gap 8 and align with each other in the process.

The gap seal 9 includes a band-form or strip-form sealing element 12, which for example can be formed of a flat metal component. The term "flat" in this case determines that the sealing element 12 has larger dimensions in its axial longitudinal direction and in its transverse direction which extends parallel to the circumferential direction 3, than in its radial thickness direction. The sealing element 12 is dimensioned so that it engages with its longitudinal sides 13, 14 in the two longitudinal slots 10, 11 in the circumferential direction 3. As a result of this, the sealing element 12 bridges the gap 8 in the region of an axial longitudinal end.

The one or first blade 1 has a projection 15 on its blade root 6, which projects from the first blade root 6 in the circumferential direction 3. This projection 15 in this case extends in the circumferential direction 3 and also radially, at least in the region of the associated longitudinal slot 10. The projection 15 preferably extends over the whole radial height of the first blade root 6. Complementary to the projection 15, the other or second blade 2 has a step-shaped recess 16 on its blade root 7, into which the projection 15 engages in the installed state which is shown. In doing so, the projection 15 projects into the recess 16 in the circumferential direction 3.

The gap seal 9 now also includes a transverse slot 17 which is recessed into the projection 15, in fact so that it extends in the circumferential direction 3 and is open towards the gap 8. In this case, the transverse slot 17 is positioned at the level of the longitudinal slots 10, 11. Consequently, the sealing element 12 axially engages in the transverse slot 17 with an end face 18 which faces the projection 15. The gap seal 9 which is formed in this way is characterized by an increased sealing effect.

The transverse slot 17 is expediently configured so that is directly merges into the first longitudinal slot 10. The second longitudinal slot 11 is open on the end face, that is to say axially open, in the region of the recess 16. The projection 15 is expediently dimensioned in the circumferential direction 3 so that it overlaps the end-face open end of the second longitudinal slot 11 in the recess 16. In this case, the dimensioning of the projection 15 is preferably matched to the second longitudinal slot 11 so that the projection 15 overlaps the recess 16 to such an extent that the transverse slot 17 can be configured closed on the two end-face ends. In the example which is shown, the projection 15, in an end-face end section of the transverse slot 17 which faces the second blade 2, forms a closure of this end-face end of the transverse slot 17. As a result, leakage through the transverse slot 17 can be avoided.

The embodiment which is shown here is preferred, in which the recess 16 and the projection 15 are matched to each other so that the projection 15 in the installed state inside the recess 16, which is shown, lies axially on the second blade root 7. With this, an extensive and consequently leakproof contact between projection 15 and second blade root 7 is preferred. As a result, leakages due to flow passing around the projection 15 inside the recess 16 can also be reduced. Furthermore, the transverse slot 17 can also seamlessly merge into the second longitudinal slot 11 as a result.

An embodiment is preferred in which the transverse slot 17, with regard to its slot depth, and the sealing element 12 with regard to its axial extent, are matched to each other so that the sealing element 12 can also still engage with its end face 18 deeply enough in the transverse slot 17 in order to be able to ensure a desired sealing effect, when the customary manufacturing tolerances which are to be expected within the scope of manufacture, and also the customary expansion processes which are to be expected during operation of the turbomachine, have extreme values and unfavorably add up.

The gap seal 9 which is described here can therefore also bring about adequate sealing of the gap 9 in the region of the end face 18 for customary manufacturing tolerances and thermal expansion processes.

It is clear that the two blades 1, 2 in principle can be identical, so that also the second blade 2 similarly has such a projection 15 on its side which faces away from the first blade 1 and then engages in turn in a recess 16 which is formed on the further blade which follows the second blade 2 in the circumferential direction 3. By the same token, the first blade 1 has such a recess 6 on its blade root 6 on its side which faces away from the second blade 2, in which engages a projection 15 which is formed on a further blade which is adjacent to the first blade 1 in this direction.

LIST OF DESIGNATIONS

1 First blade
2 Second blade
3 Circumferential direction
4 Axial direction
5 Radial direction
6 Blade root of 1
7 Blade root of 2
8 Gap
9 Gap seal
10 Longitudinal slot of 6
11 Longitudinal slot of 7
12 Sealing element
13 Longitudinal side of 12
14 Longitudinal side of 12
15 Projection
16 Recess
17 Transverse slot
18 End face of 12

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A gap seal for radially sealing a gap which extends axially and radially between two blades of a turbomachine, the seal comprising:

first and second circumferentially adjacent blades, the blades forming an axially and radially extending gap between the blades, each blade having a root and an axially extending longitudinal slot open towards the gap on each blade root, each slot having an axial end;

a strip sealing element having longitudinal sides which engage in the two longitudinal slots and bridges the gap;

wherein the first blade has a projection on the first blade root circumferentially projecting from the first blade root and circumferentially and radially extending at least in the region of the first blade longitudinal slot and bridges the axial longitudinal end of the gap;

wherein the second blade has a step-shaped recess on the second blade root which recess is complementary to the projection of the first blade and in which recess the projection engages;

wherein the projection has a transverse slot which extends in the circumferential direction and is open towards the gap; and wherein the sealing element includes an end face which engages in the transverse slot.

2. The gap seal as claimed in claim 1, wherein:

the longitudinal slot of the second blade terminates in the recess open on the end face; and the projection is dimensioned in the circumferential direction so that it overlaps the end-face open end of the longitudinal slot of the second blade in the recess.

3. The gap seal as claimed in claim 1, wherein the transverse slot has closed end-face ends.

4. The gap seal as claimed in claim 1, wherein the projection and the recess are matched to each other so that the projection in the recess lies axially on the second blade root.

5. The gap seal as claimed in claim 1, wherein:

the first and second blades are rotor blades of a rotor of the turbomachine; or the first and second blades are stator blades of a stator of the turbomachine.

6. The gap seal as claimed in claim 1, wherein the transverse slot and the sealing element are dimensioned and matched to each other so that with expected manufacturing tolerances and thermal expansion, the sealing element can engage with its end face deeply enough in the transverse slot to seal the gap.

* * * * *